US010612889B1

(12) United States Patent
Wyka

(10) Patent No.: US 10,612,889 B1
(45) Date of Patent: Apr. 7, 2020

(54) ELONGATED REAR SIGHT FOR A FIREARM

(71) Applicant: Sean Wyka, Plainville, KS (US)

(72) Inventor: Sean Wyka, Plainville, KS (US)

(73) Assignee: Triclops Sights, LLC, Colorado Springs, CO (US)

( * ) Notice: Subject to any disclaimer, the term of this patent is extended or adjusted under 35 U.S.C. 154(b) by 0 days.

(21) Appl. No.: 16/375,967

(22) Filed: Apr. 5, 2019

(51) Int. Cl.
*F41G 1/08* (2006.01)
*F41G 1/34* (2006.01)

(52) U.S. Cl.
CPC ..... *F41G 1/08* (2013.01); *F41G 1/345* (2013.01)

(58) Field of Classification Search
CPC ..... F41G 1/08; F41G 1/02; F41G 1/34; F41G 1/345
USPC ..... 42/131, 132, 140, 145
See application file for complete search history.

(56) References Cited

U.S. PATENT DOCUMENTS 2,256,411 A * 9/1941 Russell ..... F41G 1/01 42/130
4,070,763 A * 1/1978 Carts, Jr. ..... F41G 1/32 250/467.1
4,745,698 A 5/1988 Schwulst
5,065,538 A 11/1991 Allen
5,638,604 A 6/1997 Lorocco
5,822,872 A 10/1998 Waki
5,878,503 A 3/1999 Howe et al.
6,068,483 A 5/2000 Minor
6,446,377 B1 9/2002 Hollenbach et al.
6,678,987 B2 * 1/2004 Howe ..... F41G 1/01 42/132
7,905,044 B2 3/2011 Clouser
9,328,993 B1 5/2016 Heacock
9,909,838 B1 3/2018 Jackson
2013/0097881 A1 * 4/2013 Profos ..... F41G 1/345 33/263
2016/0169622 A1 * 6/2016 Graziano ..... F41G 1/467 124/25.6

* cited by examiner

*Primary Examiner* — Stephen Johnson
(74) *Attorney, Agent, or Firm* — Williams Intellectual Property; Timothy Snyder

(57) ABSTRACT

An elongated rear sight for a firearm is described herein. The elongated sight includes an elongated aperture bounded by a top portion, a first side portion, and a second side portion. A first elongated rod is interior and approximate to the top portion, and extends along a length of the top portion. A second elongated rod is interior and approximate to the first side portion, and extends along a length of the first side portion. A third elongated rod is interior and approximate to the second side portion, and extends along a length of the second side portion. The elongated rods may be light gathering rods that glow in the presence of light. The elongated aperture channels a user's eye(s) towards the target, while the three elongated rods are used to align with a front sight of the firearm to aim towards a target.

18 Claims, 5 Drawing Sheets

ELONGATED REAR SIGHT FOR A FIREARM

BACKGROUND OF THE INVENTION

Various types of firearm sights are known in the prior art. One of the most common sights is a blade and notch configuration, where the blade acts as a front sight and the notch acts as a rear sight. Several problems exist with blade and notch sights. For example, due to the blade and notch configuration, the user commonly ends up aiming the firearm too high, resulting in the shot being high of the target. The user also has to close one eye to avoid double vision, which affects the user's depth perception. Another common firearm sight is a hooded design. A notch or other projection protruding from the sides or bottom of the firearm is positioned within the hood to be aligned with a front sight. Hood designs also require the user to close one eye to avoid having double vision. This double vision is particularly caused by the shortened/thin profile designs of the blade and notch, or hood designs. Finally, sighted firearm scopes also exist having light or a projected laser to aid in aiming the firearm. One particular problem with these sights is the need for a power source to illuminate the light or laser, which makes these sights prone to failure when the power source dies.

Thus there exists a need for an improved firearm sight to channel a user's eye(s) towards a target while overcoming the aforementioned problems.

FIELD OF THE INVENTION

The present invention generally relates to firearm sights, and more particularly to an elongated rear sight for a firearm having elongated rods strategically positioned to permit a user to quickly and accurately aim a firearm without having their vision or depth perception impaired.

SUMMARY OF THE INVENTION

The general purpose of the elongated rear sight, described subsequently in greater detail, is to provide an elongated rear sight which has many novel features that result in an elongated rear sight which is not anticipated, rendered obvious, suggested, or even implied by prior art, either alone or in combination thereof.

An elongated rear sight for a firearm is described herein. The elongated rear sight includes an elongated aperture bounded by at least a top portion, a first side portion, and a second side portion opposing the first side portion. The elongated aperture has a longitudinal axis configured to align along a longitudinal axis of a firearm barrel and be attached to a rear end of the firearm to act as a rear sight. A first elongated rod is positioned inside the aperture and approximate to the top portion, where the first elongated rod extends along at least a portion of a central longitudinal axis of the top portion. A second elongated rod is positioned inside the aperture and approximate to the first side portion, where the second elongated rod extends along at least a portion of a longitudinal axis of the first side portion. A third elongated rod is positioned inside the aperture and approximate to the second side portion, where the second elongated rod extends along at least a portion of a longitudinal axis of the second side portion.

The first elongated rod, second elongated rod, and third elongated rod may be light gathering rods that glow in the presence of light. The light gathering rods may be fiber optic rods. In this case, there is no need for a power source to operate the rear sight.

The elongated rear sight further includes a first opening, a second opening, and a third opening. The first opening is in the top portion to permit light to contact the first elongated rod. The second opening is in the first side portion to permit light to contact the second elongated rod. The third opening is in the second side portion to permit light to contact the third elongated rod. The first opening, second opening, and third opening may be in the shape of a slot.

The elongated aperture may be further bounded by a bottom portion opposing the top portion, where an exterior side of the bottom portion is configured to attach to the rear end of the firearm. The exterior side may include at least one of an adhesive, a fastening element, or a part of a joint mechanism. In specific embodiments, the elongated aperture attaches to a firearm by way of a dovetail joint.

The elongated rear sight may further include a projection protruding out from the rear of either the first side portion or the second side portion depending on a dominant eye of the user.

The elongated aperture may be in the form of a rectangular box, where the top portion is a top wall of the rectangular box, the first side portion is a first side wall of the rectangular box, and the second side portion is a second side wall of the rectangular box. Other forms of the elongated aperture are also contemplated including a cylinder and a triangular prism.

A method of using the elongated rear sight is also described herein. The elongated aperture is assembled to the rear end of the firearm. The firearm is aimed towards a target by aligning a front sight of the firearm with the first elongated rod, the second elongated rod, and the third elongated rod. Once aligned, the firearm is fired towards the target.

Thus has been broadly outlined the more important features of the present elongated rear sight so that the detailed description thereof that follows may be better understood and in order that the present contribution to the art may be better appreciated.

Objects of the present elongated rear sight, along with various novel features that characterize the invention are particularly pointed out in the claims forming a part of this disclosure. For better understanding of the elongated rear sight, its operating advantages and specific objects attained by its uses, refer to the accompanying drawings and description.

BRIEF DESCRIPTION OF THE DRAWINGS

Figures

DETAILED DESCRIPTION OF THE DRAWINGS

The present invention has utility as a rear sight for a firearm to permit a user to quickly and accurately aim a firearm without having their vision or depth perception impaired. The rear sight is particularly helpful in channeling a user's eye(s) towards a target. The rear sight may be used for any situation and for any firearm illustratively including pistols, shotguns, rifles, and machine guns. The rear sight is also particularly advantageous in improving a user's speed in which they can aim the firearm, as well as improving their target accuracy over a shorter period of time compared to conventional sights. Other advantages include the absence of a power source to use the rear sight, and the ability to accurately aim the firearm with both eyes open. The following description of various embodiments of the invention is not intended to limit the invention to those specific embodiments, but rather to enable any person skilled in the art to make and use this invention through exemplary aspects thereof.

With reference now to the drawings, and in particular FIGS. 1 through 9 thereof, example of the instant elongated rear sight employing the principles and concepts of the present elongated rear sight and generally designated by the reference number 10 will be described.

Figure 8:
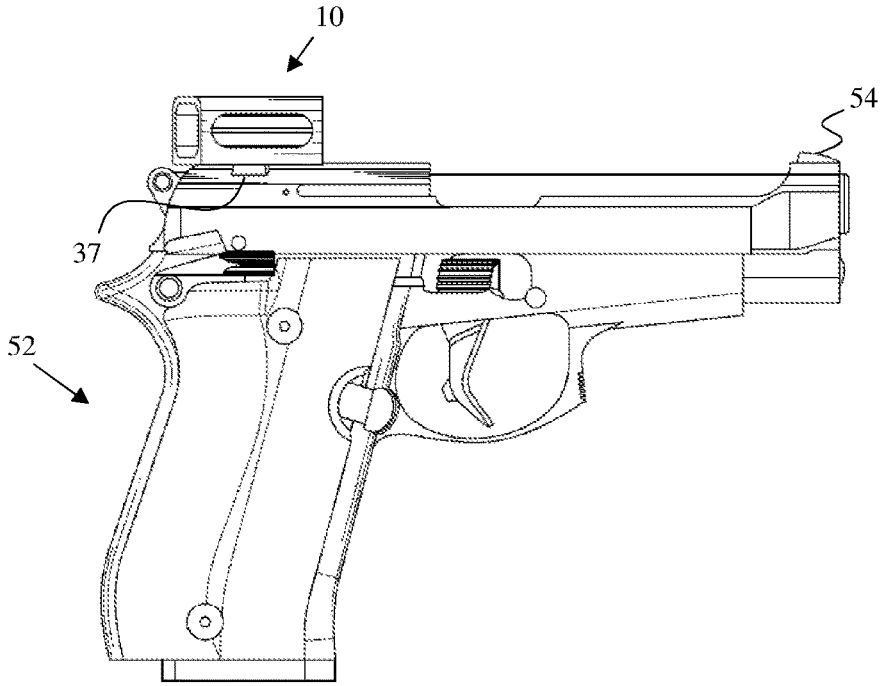
FIG. 8 depicts a side view of an elongated rear sight attached to a firearm in accordance with embodiments of the invention.
Figure 9:
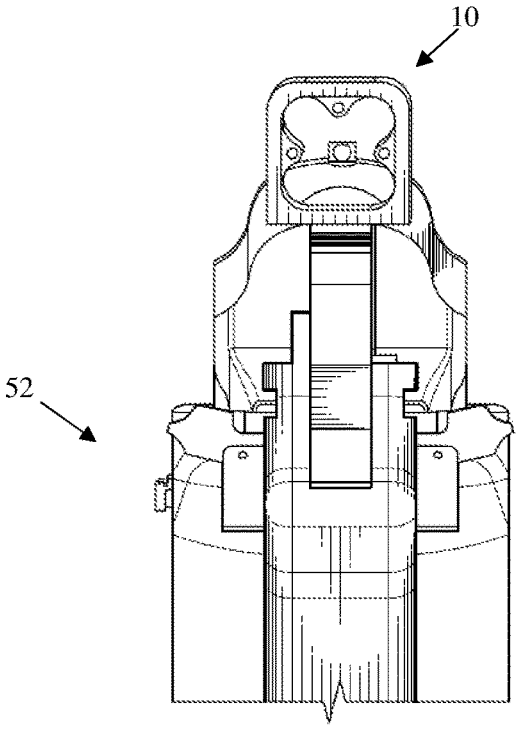
FIG. 9 depicts a rear view of an elongated rear sight attached to a firearm with three elongated rods aligned with a front sight of the firearm in accordance with embodiments of the invention.

Referring to FIGS. 1 through 9, a preferred embodiment of the present elongated rear sight 10 is illustrated. The elongated rear sight 10 includes an elongated aperture 12 bounded by at least a top portion 14, a first side portion 16, and a second side portion 18 opposing the first side portion 16. The elongated aperture 12 has a longitudinal axis configured to align along a longitudinal axis of a firearm barrel and be attached to a rear end of a firearm to act as a rear sight as shown in FIGS. 8 and 9. The rear sight 10 further includes a first elongated rod 20, a second elongated rod 22, and a third elongated rod 24. The first elongated rod 20 is positioned inside the aperture 12 and approximate to the top portion 14, where the first elongated rod 20 extends along at least a portion of a central longitudinal axis of the top portion 14. The second elongated rod 22 is positioned inside the aperture 12 and approximate to the first side portion 16, where the second elongated rod 22 extends along at least a portion of a longitudinal axis of the first side portion 16. The third elongated rod 24 is positioned inside the aperture 12 and approximate to the second side portion 18, where the third elongated rod 24 extends along at least a portion of a longitudinal axis of the second side portion 18. As can be seen in the figures, the first elongated rod 20 is more specifically positioned adjacent to the top portion 14 and visible through the aperture 12, the second elongated rod 22 is more specifically positioned adjacent to the first side portion 16 and visible through the aperture 12, and the third elongated rod 24 is more specifically positioned adjacent to the second side portion 18 and visible through the aperture 12. With reference to FIGS. 8 and 9, to aim a firearm 52, a user aligns a front sight 54 of the firearm (e.g., a blade) with the first elongated rod 20, the second elongated rod 22, and the third elongated 24 in the aperture 12. The elongated aperture 12 advantageously channels the user's eyes down the barrel and in the direction of the target to improve the user's aiming speed and accuracy. In addition, the elongated rods (20, 22, and 24) are strategically positioned to align the firearm 52 in four degrees-of-freedom, which are all the degrees-of-freedom necessary to accurately align the firearm 52 on a single target point. Further, having the first elongated rod 20 positioned along a top portion 14 of the aperture 12 improves the speed at which a user can align the firearm and eliminates the effects of aiming above a target, which is typical of conventional sights.

The first elongated rod 20, second elongated rod 22, and third elongated rod 24 may extend along the entire longitudinal length of the aperture 12, or just a portion thereof. However, longer rods (20, 22, and 24) gather more light to intensify the glow if the rods (20, 22, and 24) are light gathering rods as described below. Further, the second elongated rod 22 and third elongated rod 24 may extend along a central longitudinal axis of the first side portion 16 and second side portion 18 respectively, or the second and third rod (22, 24) may extend off-axis from the central longitudinal axis depending on the overall dimensions of the aperture 12. In a preferred embodiment, the elongated rods (20, 22, 24) are optimally positioned approximate to the first side portion 16 and second side portion 18, respectively, for accurate use on any firearm.

In specific inventive embodiments, the first elongated rod 20, second elongated rod 22, and third elongated rod 24 are light gathering rods that glow in the presence of light (e.g., ambient light, artificial light). These light gathering rods may be fiber optic rods or other rods capable of gathering light to produce a glow effect. Therefore, the elongated rods (20, 22, and 24) glow in the presence of light to aid in aligning the elongated rods (20, 22, and 24) with a front sight. In addition, since the light gathering rods glow in the presence of light, there is no need for a power source to aid in aiming the firearm, which is highly advantageous. To improve the transmission of light to the elongated rods, the bounding portions of the aperture 12 further include openings. The top portion 14 may include a first opening 26 to permit light to contact the first elongated rod 20, the first side portion 16 may include a second opening 28 to permit light to contact the second elongated rod 22, and the second side portion 18 may include a third opening 30 to permit light to contact the third elongated rod 24. It is also contemplated that the top portion 14, first side portion 16, and second side portion 18 may include a series of openings along their length to permit light to contact the rods (20, 22, and 24). The openings (26, 28, and 30) provide significant functionality to a rear sight 10 of this design. Because the elongated aperture 12 is bounded by the top portion 14, first side portion 16, second side portion 18, and a bottom portion (a bottom portion being a rear end of the firearm on which the aperture sits upon, or part of the rear sight itself as described below), the ability for light to contact and illuminate the elongated rods (20, 22, and 24) is limited. An elongated aperture 12 is necessary to channel the user's eyes towards the front sight, and therefore the openings (26, 28 and 30) permit this channeling functionality while further allowing light to contact the elongated rods (20, 22, and 24).

In particular inventive embodiments, the dimensions and position of the openings (26, 28, and 30) are optimized to permit light to contact a majority of each elongated rods (20, 22, and 24), while further creating reduced light regions at opposing ends of the aperture 12. The reduce light regions create a more perceivable glow of the rods (20, 22, and 24) at the rear end and front end of the aperture 12, which are the most helpful and important parts of the rods (20, 22, and 24) to align with a front sight. The geometry and position of the openings (26, 28 and 30) may be the following. Each opening (26, 28, and 30) may be elongated having a central longitudinal axis aligned with the longitudinal axis of their closest elongated rod (20, 22, and 24). A central transverse axis of each opening (26, 28, and 30) may be aligned with a central transverse axis of each of their closest elongated rod (20, 22, and 24). In this configuration, the amount of light capable of reaching the middle regions of the rods (20, 22, and 24) are maximized. However, it should be appreciated, that the openings (26, 28, and 30) may align off-axis from the longitudinal axis and/or central transverse axis of the rods (20, 22, and 24) while still permitting light to contact the rods (20, 22, and 24). In a preferred embodiment, the openings (26, 28, and 30) are in the form of a slot, while in other embodiments, the openings (26, 28, and 30) are in the form of a rectangle, square, slits, or an ellipse. To create the reduced light regions, the longitudinal length of the opening (26, 28, and 30) is shorter than the longitudinal length of the aperture 12. Therefore, the areas of the aperture 12 extending beyond the openings (26, 28, and 30) in the longitudinal direction are fully enclosed by the top portion, first side portion, second side portion, and a bottom portion to reduce the light exposure at these regions. Thus, the glow of the elongated rods (20, 22, and 24) is maximized by the light contacting the majority of the middle region of the rods (20, 22, and 24), and further intensified by the reduced light regions at the opposing ends of the aperture 12. The light is therefore transferred, directed, and controlled to where it utilizes the elongated rods (20, 22, and 24) to their maximum utility. In addition, the more light gathering rod there is to gather light, the stronger the resultant glow, which is another advantage of having the rods (20, 22, and 24) elongated.

The elongated rear sight further includes one or more mechanisms to attach or connect the aperture 12 with the rear end of a firearm. In a particular embodiment, the first side portion 16 and second side portion 18 each include bottom feet. The bottom feet may include a fastening element (e.g., clamp, clip, screw), or part of a joint mechanism to attach with the rear end of the firearm. For example, the bottom feet may be in the form of a tongue configured to slide on a groove positioned on the rear end of the firearm. When the aperture 12 is attached to the firearm by way of the bottom feet, the rear end of the firearm may act as a bounding bottom to the aperture 12. In a preferred embodiment, the aperture 12 itself is bounded by a bottom portion 34 that opposes the top portion 14. The bottom portion 34 may have an exterior side configured to attach or connect with the rear end of the firearm. The exterior side of the bottom portion 34 may include for example an adhesive, a fastening element, or a part of a joint mechanism. In a preferred embodiment, the exterior side includes a part of a joint mechanism, where the part is a dovetail pin 36 configured to interlock with a dovetail 37 (as shown in FIG. 8) situated on the rear end of the firearm to form a dovetail joint. A dovetail joint is particularly advantageous to secure the aperture 12 to the firearm in a quick and secure manner. It should be appreciated however, that other attachment/connection mechanisms may be used to attach/connect the aperture 12 to the firearm.

Figure 1:
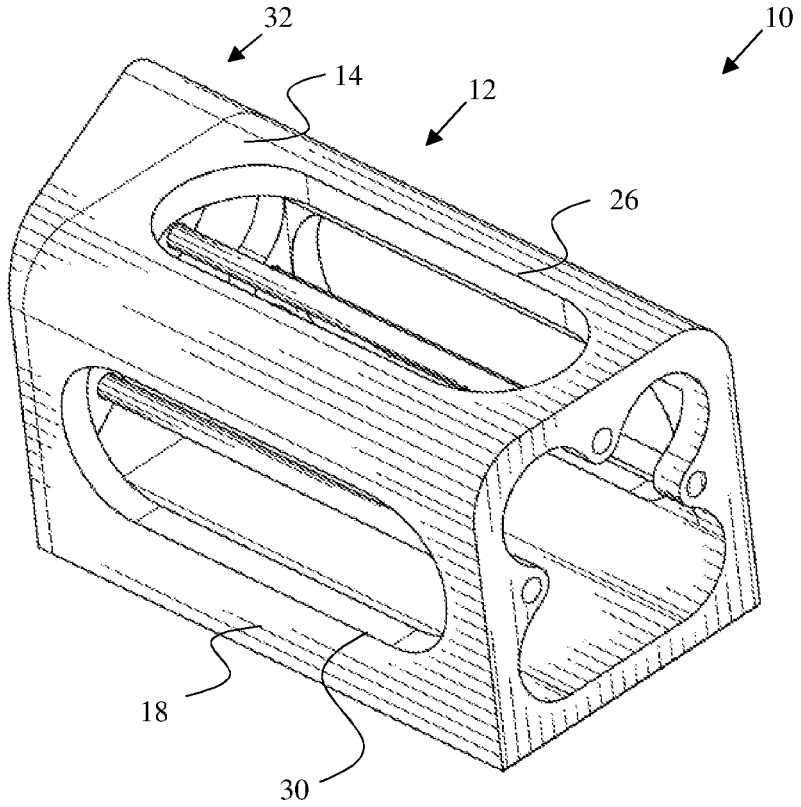
FIG. 1 is a front perspective view of an elongated rear sight in accordance with embodiments of the invention.
Figure 2:
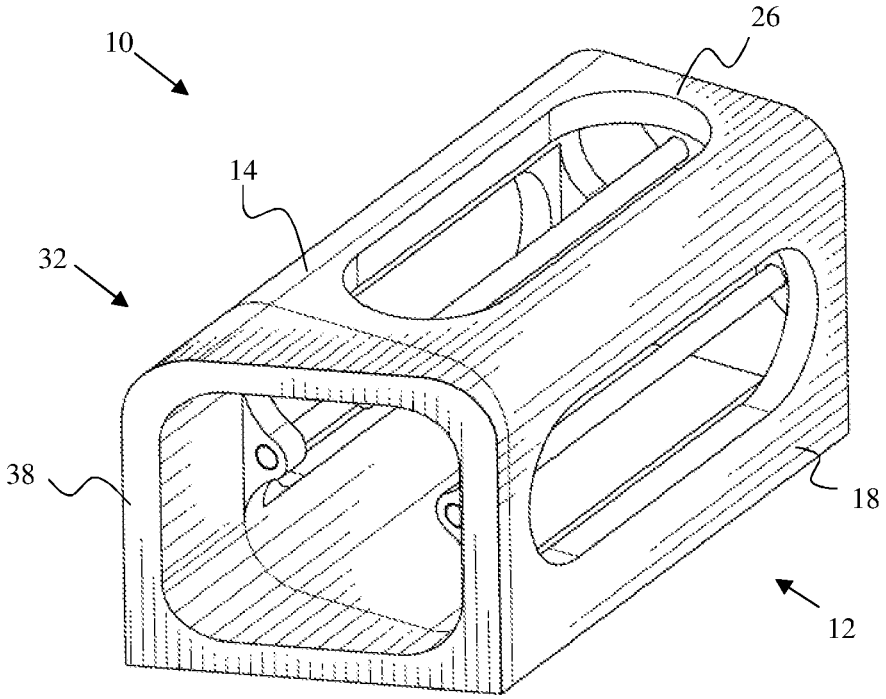
FIG. 2 is a rear perspective view of an elongated rear sight in accordance with embodiments of the invention.
Figure 3:
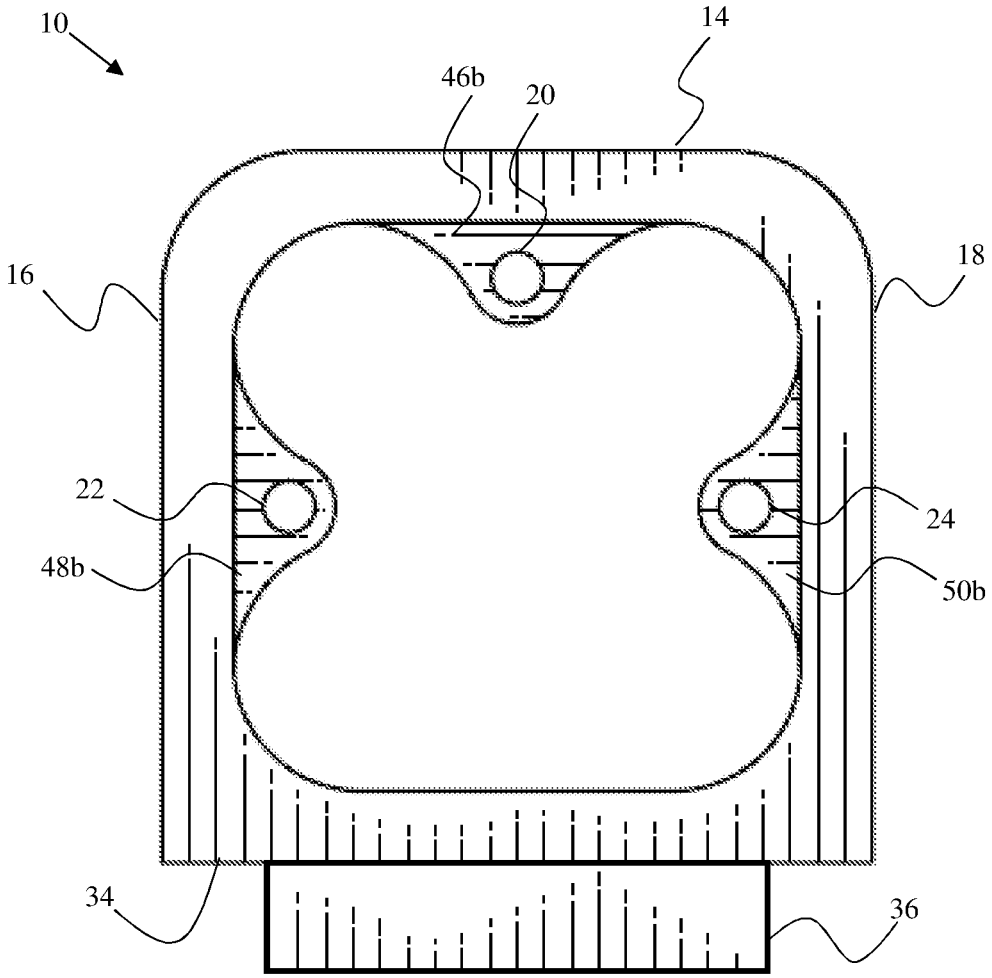
FIG. 3 is a rear view of an elongated rear sight looking through an aperture thereof in accordance with embodiments of the invention.
Figure 4:
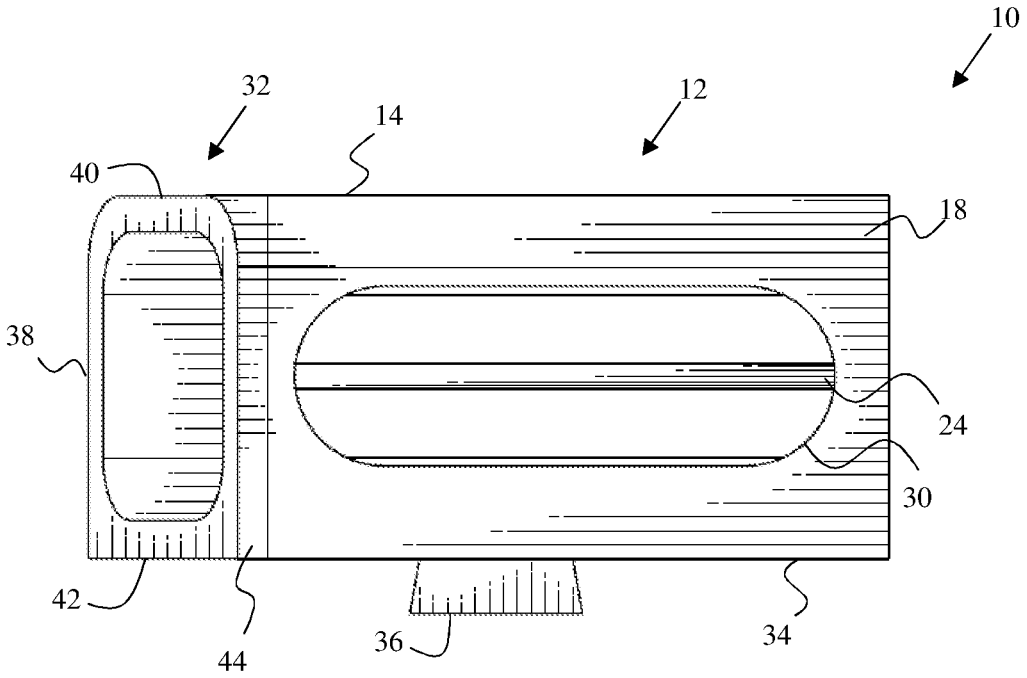
FIG. 4 is a first side view of an elongated rear sight in accordance with embodiments of the invention.
Figure 5:
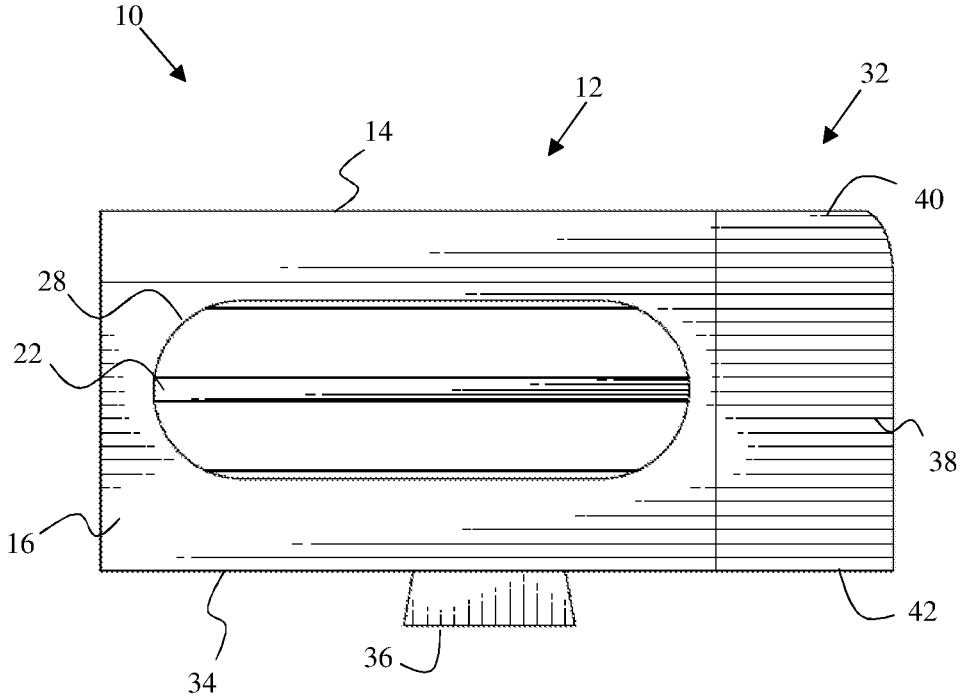
FIG. 5 is a view of an elongated rear sight from a second side view opposing the first side view as shown in FIG. 4 in accordance with embodiments of the invention.
Figure 6:
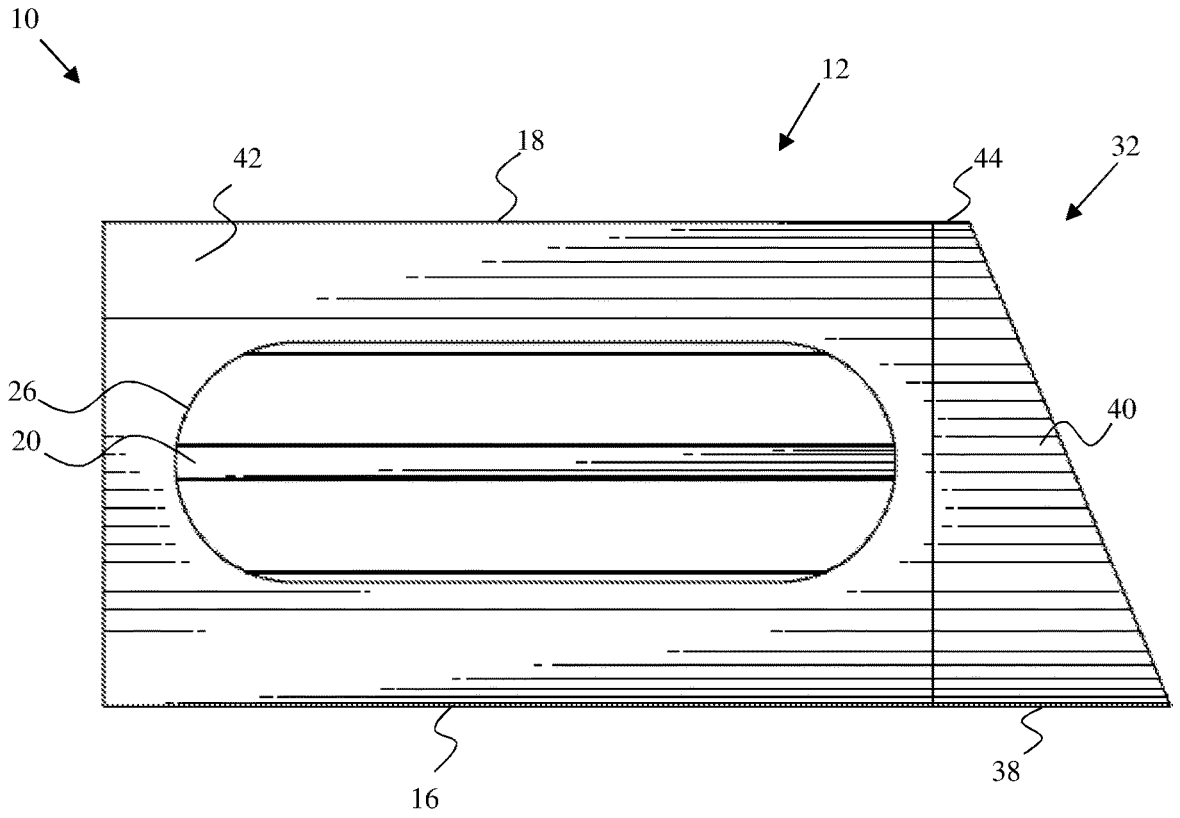
FIG. 6 is a top view of an elongated rear sight in accordance with embodiments of the invention.
Figure 7:
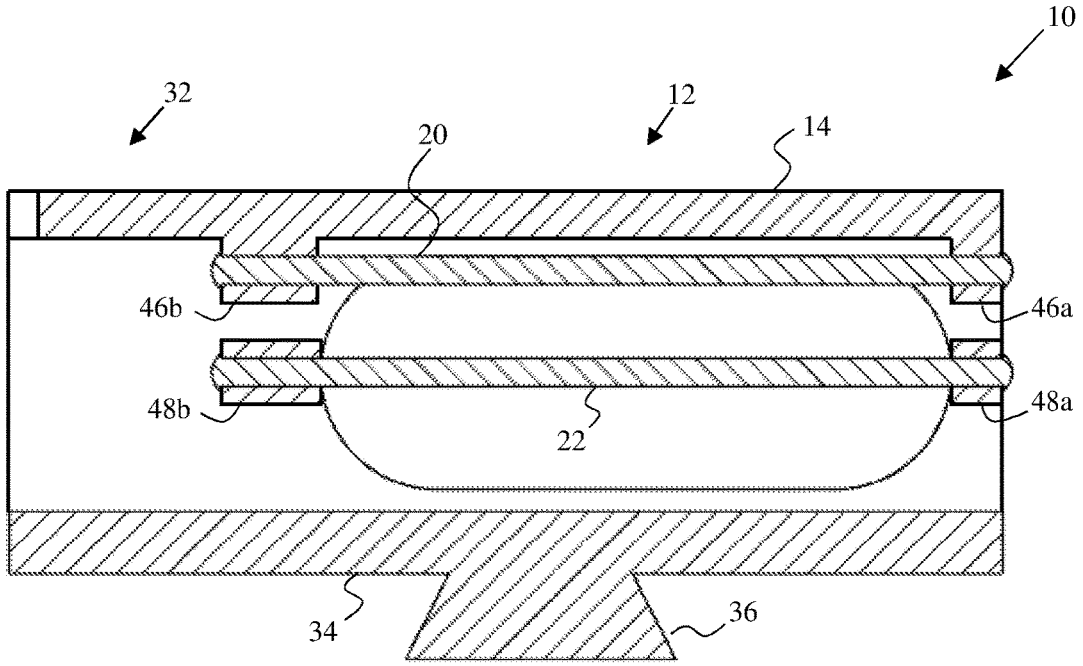
FIG. 7 is a side view of a longitudinal cross-section of an elongated rear sight in accordance with embodiments of the invention.

The elongated rear sight may further include a projection 32 protruding out from the rear of either the first side portion 16 or the second side portion 18 depending on a dominant eye of the user. The projection 32 acts as an eye relief and focuses the dominant eye through the aperture 12 even when the user is aiming with both eyes open. This helps to reduce double vision, and since the user can aim with both eyes open, the user's depth perception is not compromised. The projection 32 may be manufactured as part of the top portion 14, first side portion 16, and second side portion 18 to form a monolithic structure thereof, while in other embodiments, the projection 32 may be a separate piece that is attachable to the rear of either the first side portion 16 or the second side portion 18. In some embodiments, the projection 32 is a separate piece that is interchangeable between the first side portion 16 and second side portion 18 to accommodate different users with different dominant eyes. The projection 32 may further include a first side projection 38, a top projection 40, and a bottom projection 42, all of which form a monolithic projection around the rear of the aperture 12. The first side projection 38 protrudes from the rear of either the first side portion 16 or the second side portion 18, the top projection 40 protrudes from the rear of the top portion 14, and the bottom projection 42 protrudes from the rear of the bottom portion 34. To channel the user's dominant eye, the top projection 40 and bottom projection 42 are sloped starting at the first side projection 38 and down towards whichever first side portion 16 or second side portion 18 opposes the first side projection 38 as best seen in FIGS. 4 and 6. The first side projection 38 therefore protrudes farthest from the rear of the aperture 12 than the other projections (40, 42). The sloped design channels the user's dominant eye through the aperture 12 while creating a streamlined connection with the rear of the aperture 12. The projection 32 may further include a second side projection 44 protruding from the rear of the either the first side portion 16 or second side portion 18 that opposes the first side projection 38. This second side projection 44 may part of the monolithic projection that surrounds the rear of the aperture 12. To achieve the aforementioned sloped design to channel the user's dominant eye, the second side projection 44 protrudes from the rear of the aperture 12 less than the first side projection 38. The top projection 40 and bottom projection 42 are therefore sloped starting at the first side projection 38 and down towards the second side projection 44. In this context, "down" refers to a slope in a longitudinal plane of the aperture 12 that slopes from the rear of the aperture 12 and towards the front of the aperture 12.

Overall, the shape of the aperture 12 may be in many different forms. In a preferred embodiment, the elongated aperture 12 is in the form of a rectangular box as shown throughout the Figures, where the top portion 14 is a top wall of the rectangular box, the first side portion 16 is a first side wall of the rectangular box, and the second side portion 18 is a second side wall of the rectangular box. In other words, the top portion 14 is a top wall, the first side portion 16 is a first side wall that is perpendicular to the top wall, the second side portion 18 is a second side wall that is perpendicular to the top wall and opposing the first side wall, and the bottom portion 34 is a bottom wall that is parallel to and opposing the top wall 14. The box may have rounded edges where the walls meet as shown, or may have rectangular edges as described. In other embodiments, the elongated aperture 12 is in the form of a cylinder, where the top portion 14, first side portion 16, and second side portion 18 are each characterized by an arc length of the cylinder at their respective locations. In a further embodiment, the elongated aperture 12 is in the form of a triangular prism, where the top portion 14 is an apex of the triangular prism, the first side portion 16 is a first side of the triangular prism, and the second side portion 18 is a second side of the triangular prism.

To connect the elongated rods (20, 22, and 24) inside the aperture 12 at their respective locations, various mechanisms may be used. In one embodiment, the first elongated rod, second elongated rod 22, and third elongated are attached directly to the interior surfaces of the top portion 14, first side portion 16, and second side portion 18, respectively, using a fastening element or an adhesive. In a preferred embodiment, the rods (20, 22, and 24) are slightly offset from their interior surfaces and connected to the interior of the aperture 12 using a first pair of brackets (46*a*, 46*b*), a second pair of brackets (48*a*, 48*b*), and a third pair of brackets (50*a*, 50*b*). The first pair of brackets (46*a*, 46*b*) project interiorly from opposing longitudinal end regions of an interior surface of the top portion 14, the second pair of brackets (48*a*, 48*b*) project interiorly from opposing longitudinal end regions of an interior surface of the first side portion 16, and the third pair of brackets (50*a*, 50*b*) project interiorly from opposing longitudinal end regions of an interior surface the second side portion 18. The first pair of brackets (46*a*, 46*b*) are configured to receive and secure opposing ends of the first elongated rod 20, the second pair of brackets (48*a*, 48*b*) are configured to receive and secure opposing ends of the second elongated rod 22, and the third pair of brackets (50*a*, 50*b*) are configured to receive and secure opposing ends of the third elongated rod 24. Each bracket may include a hole in which to receive to the ends of the elongated rod, in which a fastening element or adhesive may be used to further secure the ends of the rods therein.

The rear sight 10 may be constructed using manufacturing techniques known in the art illustratively including traditional machining or 3-D printing. In some embodiments, the top portion 14, first side portion 16, second side portion 18, and bottom portion 34 (if present) are constructed as a single monolithic structure, where the projection 32, brackets (46, 48, 50) (if present), and elongated rods (20, 22, and 24) are assembled thereto. In other embodiments, the top portion 14, the first side portion 16, the second side portion 18, the bottom portion 34 (if present), the projection 32 (if present), and the brackets (46, 48, and 50) (if present) are constructed as a single monolithic structure, where the elongated rods (20, 22, and 24) are subsequently assembled thereto. It should be appreciated that various combinations of construction exist in light of the foregoing. Materials for construction include metals and polymeric material. Examples of metals include steel, aluminum, carbide, and titanium. Examples of polymeric materials include polycarbonate, acrylonitrile-butadiene-styrene (ABS), engineered plastics, polyvinylchloride (PVC), and other rigid polymeric materials.

Other Embodiments

While at least one exemplary embodiment has been presented in the foregoing detail description, it should be appreciated that a vast number of variations exist. It should also be appreciated that the exemplary embodiment or exemplary embodiments are only examples, and are not intended to limit the scope, applicability, or configuration of the described embodiments in any way. It should be understood that various changes may be made in the function and arrangement of elements without departing from the scope as set forth in the appended claims and the legal equivalents thereof.

What is claimed is:

1. An elongated rear sight for a firearm, comprising an elongated see-through aperture bounded by a top wall, a first side wall perpendicular to the top wall, and a second side wall perpendicular to the top wall and opposing the first side wall, said elongated aperture having a longitudinal axis configured to align along a longitudinal axis of a firearm barrel and be attached to a rear end of the firearm to act as a rear sight;

a first elongated rod positioned adjacent to the top wall and visible through the aperture, said first elongated rod extending along at least a portion of a central longitudinal axis of the top wall;

a second elongated rod positioned adjacent to the first side wall and visible through the aperture, said second elongated rod extending along at least a portion of a longitudinal axis of the first side wall; and a third elongated rod positioned adjacent to the second side wall and visible through the aperture, said third elongated rod extending along at least a portion of a longitudinal axis of the second side wall.

2. The elongated rear sight of claim 1 wherein the first elongated rod, second elongated rod, and third elongated rod are light gathering rods that glow in the presence of light.

3. The elongated rear sight of claim 2 wherein the light gathering rods are fiber optic rods.

4. The elongated rear sight of claim 2 further comprising a first opening through the top wall to permit light to contact the first elongated rod, a second opening through the first side wall to permit light to contact the second elongated rod, and a third opening through the second side wall to permit light to contact the third elongated rod.

5. The elongated rear sight of claim 4 wherein the first opening, second opening, and third opening are in the shape of a slot.

6. The elongated rear sight of claim 4 wherein the elongated aperture is further bounded by a bottom wall parallel to and opposing the top wall, and wherein an exterior side of the bottom wall is configured to attach to the rear end of the firearm.

7. The elongated rear sight of claim 6 further comprising a projection protruding out from a rear end of either the first side portion or the second side portion depending on a dominant eye of the user, wherein the projection is protruding parallel with the longitudinal axis of the rear sight.

8. The elongated rear sight of claim 6 wherein the top wall, first side wall, second side wall, and bottom wall are constructed of at least one of metal or a polymeric material.

9. The elongated rear sight of claim 6 wherein the exterior side includes at least one of an adhesive, a fastening element, or a part of a joint mechanism.

10. The elongated rear sight of claim 9 wherein the exterior side includes a part of a joint mechanism, and wherein said part is a pin configured to interlock with a dovetail on the rear end of the firearm to form a dovetail joint mechanism.

11. The elongated rear sight of claim 1 wherein the rear sight is absent a power source.

12. A method of using the elongated rear sight of claim 1, comprising:

assembling the elongated aperture to the rear end of the firearm;

aiming the firearm towards a target by aligning a front sight of the firearm with the first elongated rod, the second elongated rod, and the third elongated rod; and firing the firearm towards a target.

13. An elongated rear sight for a firearm comprising:

an elongated aperture bounded by a top portion, a first side portion, a second side portion opposing the first side portion, and a bottom portion opposing the top portion, said elongated aperture having a longitudinal axis configured to align along a longitudinal axis of a firearm barrel and be attached to a rear end of the firearm to act as a rear sight;

a first elongated rod positioned inside the aperture and approximate to the top portion, said first elongated rod extending along at least a portion of a central longitudinal axis of the top portion;

a second elongated rod positioned inside the aperture and approximate to the first side portion, said second elongated rod extending along at least a portion of a longitudinal axis of the first side portion;

a third elongated rod positioned inside the aperture and approximate to the second side portion, said third elongated rod extending along at least a portion of a longitudinal axis of the second side portion; and a projection protruding out from a rear end of either the first side portion or the second side portion depending on a dominant eye of the user, wherein said projection further comprises:

a first side projection, a top projection, and a bottom projection, all of which form a monolithic projection around a rear end of the aperture;

wherein the first side projection protrudes from a rear end of either the first side portion or the second side portion, the top projection protrudes from a rear end of the top portion, and the bottom projection protrudes from a rear end of the bottom portion; and wherein the top projection and bottom projection slope from the first side projection and down towards either the first side portion or the second side portion that oppose the first side projection.

14. The elongated rear sight of claim 13 where said projection further comprises:

a second side projection protruding from the rear of either the first side portion or the second side portion that oppose the first side projection, and wherein said second side projection is part of the monolithic projection; and wherein the second side projection protrudes less than the first side projection.

15. The elongated rear sight of claim 13 wherein the first elongated rod, second elongated rod, and third elongated rod are light gathering rods that glow in the presence of light.

16. The elongated rear sight of claim 15 further comprising a first opening in the top portion to permit light to contact the first elongated rod, a second opening in the first side portion to permit light to contact the second elongated rod, and a third opening in the second side portion to permit light to contact the third elongated rod.

17. An elongated rear sight for a firearm comprising:

an elongated aperture bounded by at least a top portion, a first side portion, and a second side portion opposing the first side portion, said elongated aperture having a longitudinal axis configured to align along a longitudinal axis of a firearm barrel and be attached to a rear end of the firearm to act as a rear sight;

a first elongated light gathering rod positioned inside the aperture and approximate to the top portion, said first elongated rod extending along at least a portion of a central longitudinal axis of the top portion;

a second elongated light gathering rod positioned inside the aperture and approximate to the first side portion, said second elongated rod extending along at least a portion of a longitudinal axis of the first side portion;

a third elongated light gathering rod positioned inside the aperture and approximate to the second side portion, said third elongated rod extending along at least a portion of a longitudinal axis of the second side portion;

a first opening in the top portion to permit light to contact the first elongated rod, a second opening in the first side portion to permit light to contact the second elongated rod, and a third opening in the second side portion to permit light to contact the third elongated rod; and a first pair of brackets projecting interiorly from opposing longitudinal end regions of an interior surface of the top portion, a second pair of brackets projecting interiorly from opposing longitudinal end regions of an interior surface of the first side portion, and a third pair of brackets projecting interiorly from opposing longitudinal end regions of an interior surface of the second side portion, wherein each pair of brackets is configured to receive and secure opposing ends of each said elongated rod at their respective location.

18. The elongated rear sight of claim 17 wherein each said bracket of each said pair of brackets comprise a hole to receive an end region of each said elongated rod therein.

* * * * *